United States Patent [19]

Coglan

[11] 4,042,268

[45] Aug. 16, 1977

[54] LATCH OR LOCK SET AND METHOD OF MANUFACTURE THEREOF

[76] Inventor: George Albert Carl Coglan, Astral Works, Wilden, Stourport-on-Severn, Worcestershire, DY13 9LH, England

[21] Appl. No.: 573,028

[22] Filed: Apr. 30, 1975

[51] Int. Cl.[2] ..... E05C 19/00

[52] U.S. Cl. ..... 292/347

[58] Field of Search ..... 292/353, 347–357

[56] References Cited

U.S. PATENT DOCUMENTS 3,345,103 10/1967 Parkin et al. ..... 292/353

FOREIGN PATENT DOCUMENTS 557,759 5/1946 United Kingdom ..... 292/348

*Primary Examiner*—Richard E. Moore

*Attorney, Agent, or Firm*—Melvin A. Crosby

[57] ABSTRACT

Manufacture of latch or lock set by cutting, from an extrusion of indefinite length, a portion sufficient to constitute a door lever; creating a rectangular-section barrel at one end of said portion, said barrel having a right-cylindrical recess therein; placing a square-section hollow insert in said recess, said insert having laterally directed tongues; assembling said door with a back plate so that the barrel extends through the back plate; connecting a lever-biasing spring both to the barrel and to the back plate; and securing the lever to the back plate by means of a combined D-plate and locking washer which has an aperture therein which is complementary to the barrel section, said D-plate locking washer also having lugs angled to permit them to slide along the barrel in one direction and to cause them to dig into the barrel to prevent movement in the opposite direction along the barrel.

7 Claims, 21 Drawing Figures

Fig. 14.
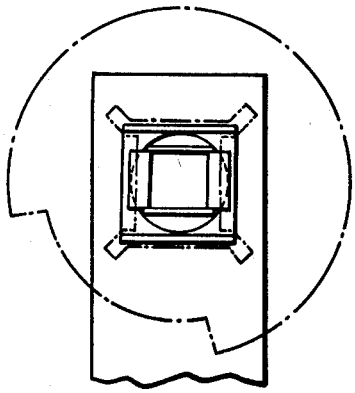
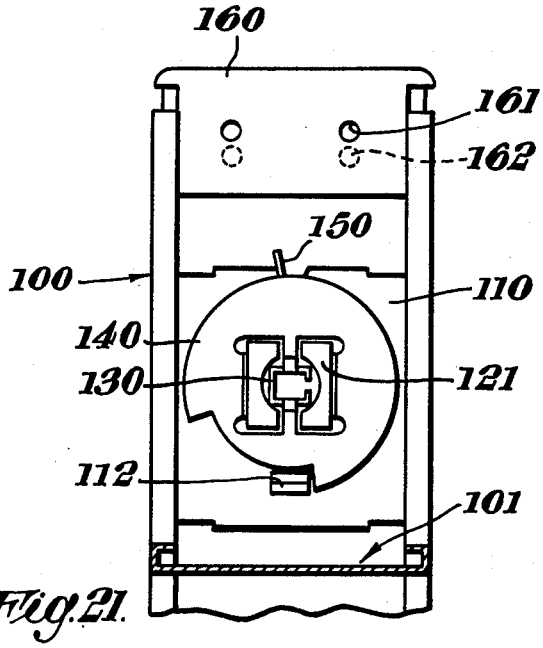
Fig. 21.

LATCH OR LOCK SET AND METHOD OF MANUFACTURE THEREOF

This invention relates to a door lever and back plate assembly (commonly known, in combination, as a latch or lock set) and to a method of manufacture of a latch or lock set. For brevity, a latch or lock set will hereinafter be called "a latch set".

FIG. 1 of the accompanying drawings illustrates an exploded view of one construction of latch set (as defined above) which will serve to exemplify the problems facing those who wish to produce latch sets. There is illustrated in FIG. 1 a lever 10, a washer 11 made of a synthetic resin material, a back plate 12, a spirally wound spring 13, a so-called double D-plate 4 and a retaining spring 15. The lever 10 and the back plate 12 are cast, often in aluminium nowadays, and need to be subjected to a number of operations before they are suitable for sale, these operations including cleaning up the casting itself where necessary (this depending on the quality of the articles as cast), linishing, polishing and anodising. Sometimes, the back plate 12 is produced by a pressing operation and sometimes the back plate consists of a channel-shaped extrusion with the addition of separately manufactured end pieces to close the open ends.

The lever 10 will be seen to comprise a portion 20 which will, in use, be gripped by the hand and a portion 21 which is substantially perpendicular to the portion 20. The portion 21 is provided with a barrel 22 which projects from the flat end face 23 of the portion 21 and which is axially aligned with the portion 21. The barrel 22 has a square-section re-entrant cavity 24 formed therein during the casting of the lever and, after the casting operation is complete, two grooves 25 (of which only one is readily visible in FIG. 1) are cut in the barrel 22 for a purpose which will become apparent.

The back plate 12 is formed with an aperture 30, an annular seat 31 on which the spring 13 will be placed, a gap 32 which is defined by the opposed ends 33 of a spring-encircling wall 34, a recessed flat surface 35 upon which the relevant marginal portions of the D-plate 14 will sit in face-to-face relationship, said surface 35 being interrupted by the gap 32 and by a stop 36.

The spring 13 has a tail 40 which is intended to be hooked around one or the other of the ends 33 and also has a central portion 41 which will be seen to be approximately of the shape necessary for said portion to engage the barrel 22 by substantially encircling it.

The D-plate 14 has a substantially centrally disposed aperture 50 whose shape is complementary to the cross-sectional shape of the barrel 22, and also has a marginal cut-away portion 51 which leads to the creation of angularly spaced abutments 52, 53.

It will be appreciated that the parts described above are assembled in the following manner:

The washer 11 is placed in the aperture 30 from the front of the back plate 12 and the lever 10 is then brought up to the back plate until the flat end face 23 is in contact with the washer 11. In that condition, the barrel 22 will project through the aperture 30 and will facilitate the central portion 41 of the spring 13 being slipped onto the barrel 22 with the cranked tail 40 engaging, say, the left-hand end 33 as seen in FIG. 1. In that condition, the convolutions of the spring 13 will be contained by the wall 34 and will be in contact with the flat annular seat 31. Thereafter, the D-plate 14 is placed over the barrel 22 in such a manner that, say, the abutment 52 is urged into contact with the face 54 of the stop 36. Lastly, the retaining spring 15 is slipped over the end of the barrel 22 into the two grooves 25, thereby ensuring that the face 23 of the lever portion 21 is held against the washer 11 and therefore also ensuring that the other parts are all held firmly in their assembled positions.

When the assembled latch set is used, the portion 20 of the lever is gripped and moved angularly in the only manner which is permitted by the D-plate 14 and the stop 36, and this angular movement will be (with the mode of assembly described above) such that the abutment 53 will be moved towards the stop 36 and this angular movement will store power in the spring 13. Release of the lever will permit the power stored in said spring 13 to act on the barrel 22 and to rotate the barrel as far as the D-plate 14 will allow, namely, until the abutment 52 is brought into contact once again with the face 54 of the stop 36.

The two latch sets which constitute the pair, one latch set being fixed to each face of the door, are connected to one another and to the latch mechanism by a square section rod whose central portion is, in use, disposed in the latch mechanism and whose end portions extend into the respective cavities 24 in the barrels 22.

It is the provision of a barrel on the lever and the provision of an axially extending square section cavity in the barrel which has necessitated the use of casting as the method of manufacture for mass-production of levers for latch sets. Casting, as a method of manufacture, is slow and therefore, expensive, besides being an unpleasantly hot mode of work for the operator. Moreover, the use of the casting process has in turn meant that the finished is expensive precisely because of the expensive "finishing" treatments to which the rough casting must be subjected before it can be considered to be fit for sale.

The principal object of the present invention is to reduce the expense of the finished (ready for sale) latch set by avoiding the use of casting as the method of manufacture of at least the lever.

An additional object is to reduce said expensive even further by reducing the number of parts which need to be assembled in order to make up a latch set; in this way, expense is curtailed not only by the provision of fewer components, but also by assembly of fewer components taking less time.

Accordingly, the present invention consists in a method of making a door lever, said method including the following steps, namely, cutting an elongated extrusion into units each of which is inherently suitable, dimensionally, for conversion into a door lever and each of which consists of integral first and second portions; reducing part of said first portion to form a protuberance and drilling a right-cylindrical recess in said protuberance, said reduction and said drilling creating a barrel which is integral with said first portion; placing an elongated hollow insert in said recess, said insert being of square cross-section and being so placed that parts of said insert engage parts of said barrel to prevent rotation of said insert within and around the longitudinal axis of said recess; and locking said insert in said recess.

According to a second aspect, the present invention further consists in a door lever which includes integral first and second portions cut from an elongated extrusion, the first portion having a barrel in which a right-cylindrical recess has been formed, an elongated hollow insert of square cross-section accommodated in said recess, said insert and said barrel having interengaging means which coact to prevent the insert from rotation within and around the longitudinal axis of said recess, and a device which is snapped into spring engagement with said barrel to keep said insert in place within said recess.

In a preferred embodiment of said lever, said device also serves, in an assembled latch set consisting of said lever and its associated back plate, as the device which is angularly movable as far as it is permitted by spaced abutments on said device and a fixed stop which is arranged in the arcuate path of travel of each of said abutments.

FIG. 1 illustrates an exploded view of one construction of latch set.

The present invention will now be more particularly described with reference to FIGS. 2 to 21 of the accompanying drawings, in which:

FIG. 14 illustrates said double D-plate applied to said assembly;

FIG. 21 illustrates a part of an assembly which consists of an extruded back plate, all the components illustrated in FIGS. 15 to 20, a washer 11, a spirally wound spring 13 and end pieces which are inserted into the open ends of the channel-shaped extruded back plate.

Figure 2:
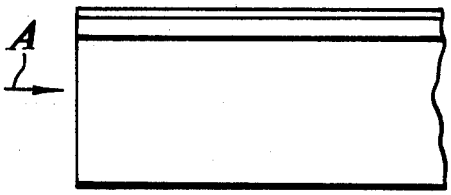
FIGS. 2 and 3 are two views of an extrusion of, for example, aluminium.
Figure 3:
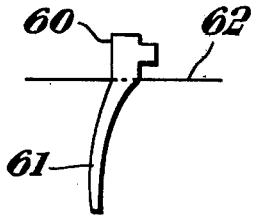

FIG. 2 illustrates a plan view of an extruded length of material (for example, aluminium) and FIG. 3 is an end view of said extruded length of material looking in the direction of the arrow A in FIG. 2. It will be seen from FIGS. 2 and 3 that the extrusion is constituted by two integral portions 60, 61, the dividing line defining where one portion ends and the other portion begins being quite arbitrarily positioned and being indicated by the reference numeral 62.

Figure 4:
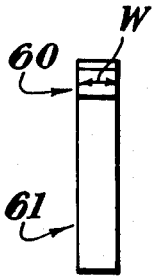
FIGS. 4 to 8 illustrate the effects of successive operations on a unit which has been cut off the extrusion shown in FIGS. 2 and 3.

FIG. 4 illustrates a plan view, similar to that of FIG. 2, of a unit cut off the extrusion shown in FIG. 2.

Figure 5:
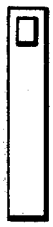
Figure 6:
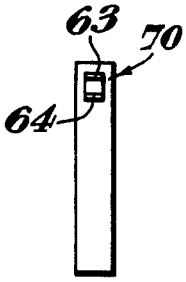
Figure 7:
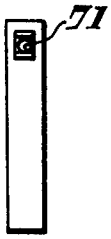
Figure 8:
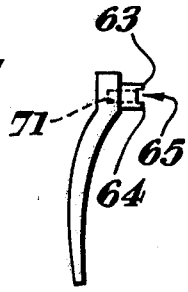

FIG. 5 illustrates the unit of FIG. 4 after a part of said first portion 60 has had its width W reduced and FIG. 6 illustrates the unit of FIG. 5 after the height of some of said part has been so reduced as to create parallel flanges 63, 64 which define a shallow channel 65 (see also FIG. 8). These reducing steps produce a protuberance indicated by the reference numeral 70 in FIG. 6, which protuberance is then drilled to produce a right-cylindrical recess 71 (FIG. 7), therein, said reducing and drilling steps, when completed, producing a barrel which is integral with the portion 60 and which is shown in plan in FIG. 7 and in side elevation in FIG. 8.

Figure 9:
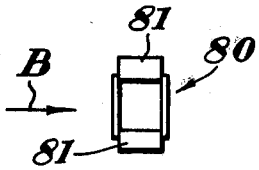
FIGS. 9, 10 and 11 are top plan, side elevation and perspective views of an insert which is intended for use with the unit of FIG. 8 and which is drawn on a larger scale than FIGS. 2 to 8.
Figure 10:
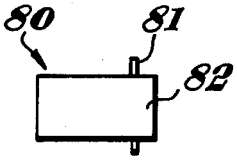
Figure 11:
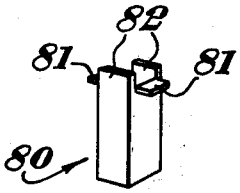

Having produced an incomplete lever with a barrel which has a right-cylindrical recess 71 in it, it is now necessary to provide means which will enable angular movement of the portion 61 about the longitudinal axis of the recess 71 to be transmitted to a square-section rod (not illustrated) of which one end lies within the confines of said recess. Said means are illustrated in FIGS. 9, 10 and 11 of which the side elevation in FIG. 10 is that view which is seen looking in the direction of the arrow B in FIG. 9. Said means is an elongated hollow insert 80 of square cross-section, corresponding one ends 81 of two opposite sides being bent outwardly to form two opposed tongues. The corresponding one ends 82 of the other two opposite sides are not bent outwardly and, consequently, are parallel to one another.

Figure 12:
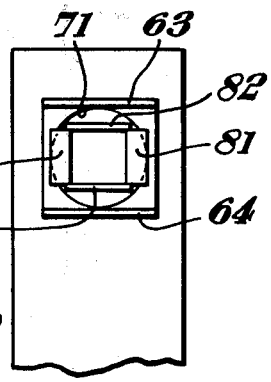
FIG. 12 is a view of said unit, similar to that shown in FIG. 7 but on a larger scale, to which said insert has been applied.

Said insert 80 is, during assembly of a latch set, placed in the right-cylindrical recess 71 in such a manner that said corresponding one ends 82 extend along the channel 65 parallel to the flanges 63, 64 and in such a manner that the outwardly bent tongues 81 extend away from one another long the channel 65 (see FIG. 12).

Figure 1:
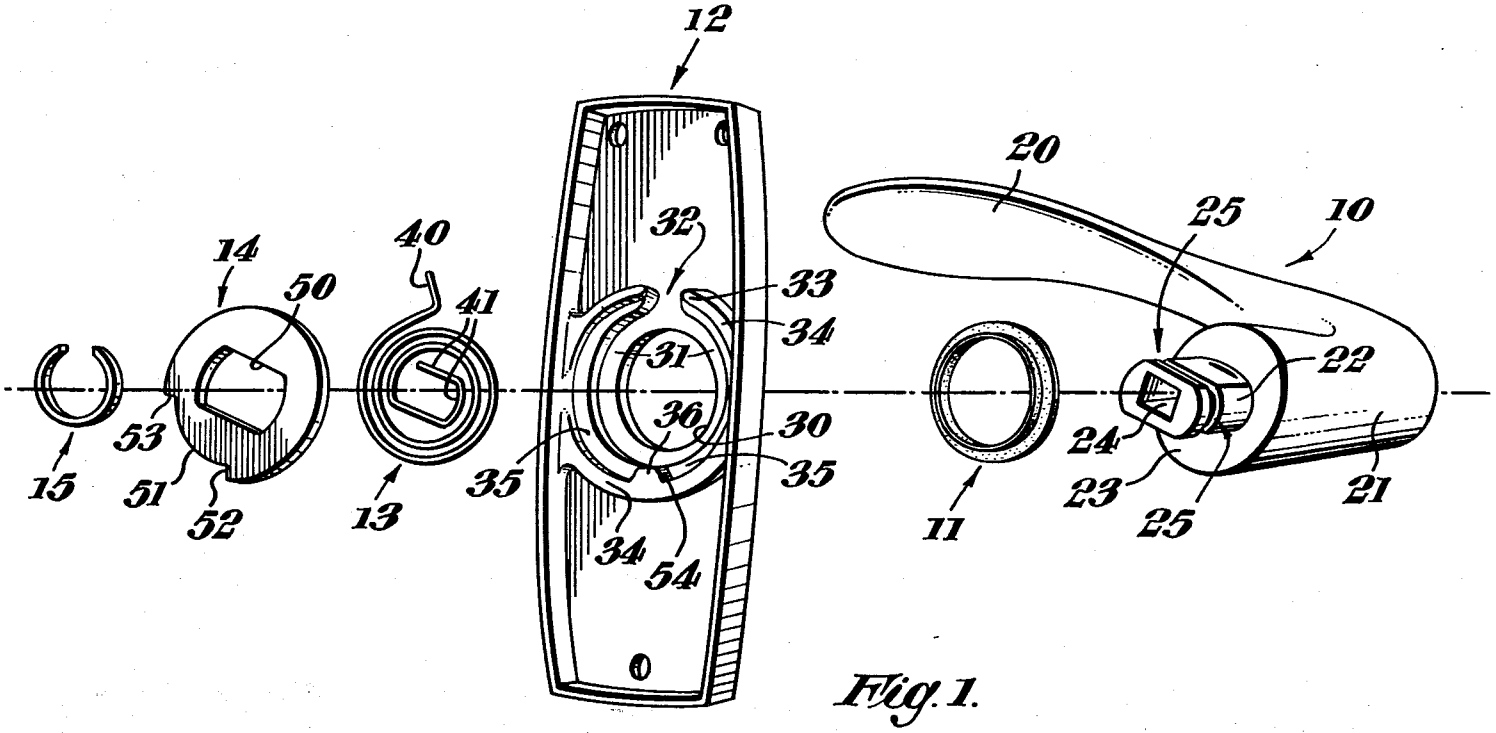
Figure 13:
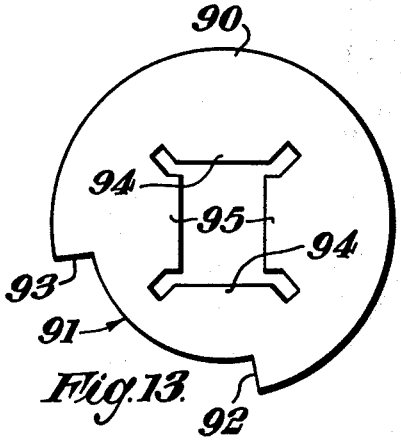
FIG. 13 illustrates a double D-plate for use with the assembly shown in FIG. 12.

FIG. 13 illustrates a plan view of the device 90 which coacts with the barrel to keep the insert 80 in place within the recess 71 and which also coacts with a stop (not illustrated) which forms part of a back plate like the one illustrated in FIG. 1. It will be seen that said device is a washer, preferably made of spring steel, from whose periphery a portion has been removed at 91 to form angularly spaced abutments 92, 93. The central portion of the device 90 is cut out to form an aperture which is approximately defined by two opposed lugs 94 and two opposed lugs 95.

When the device 90 is pushed onto the barrel (the lever 10, the washer 11, the back plate 12 and the spring 13 having been previously assembled with one another), the springy lugs 94 are deformed to slide over the outwardly directed faces of the flanges 63, 64 and the lugs 95 will extend into the channel 95 between said flanges 63, 64. This condition is illustrated in FIG. 14 from which, however, the lever 10 and the washer 11 and the back plate 12 and the spring 13 have been omitted in order to simplify the drawing. Said device 90 thus performs the two functions performed by the D-plate 14 and the retaining spring 15 in the known latch set construction illustrated in FIG. 1; the lugs 94 grip the barrel flanges 63, 64 and thereby connect the lever and the back plate to one another firmly and the lugs 95 not only overlie the tongues 81 of the insert 80 but also, in conjunction with said lugs 94, ensure that when the barrel is moved angularly, the device 90 will follow suit as far as the abutments 92, 93 and the stop on the back plate will permit.

Reference will now be made to FIGS. 15 to 21 which are drawn to various scales and which illustrate small but important modifications which have been made to facilitate the production of some of the components of a particularly attractive embodiment of a latch set (as defined above) according to the invention.

Figure 20:
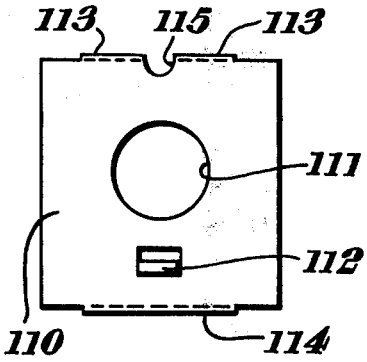
FIG. 20 illustrates a plate for use with a pressed or extruded back plate.

Instead of employing a casting for the back plate (namely, the back plate 12 shown in FIG. 1), we have found that a pressing or an extrusion could be used. However, the pressing has not so far proved entirely satisfactory and therefor for this alternative embodiment of said latch set which is commercially acceptable we have employed an extrusion 100 whose cross-sectional shape is superimposed in FIG. 21 and is indicated by the reference numeral 101 in FIG. 21. The employment of an extruded channel-section back plate means that said back plate is devoid of the aperture therein and of the several cast components which combine to produce a seat for the spirally wound spring, the gap which enables one end of said spring to be anchored, and the stop which determines the angular movements which can be made by the lever (see FIG. 1). Consequently, we provided a plate 110 (FIG. 20) which is a pressing and which is formed to have an aperture 111, an upset portion 112 which will act as a stop and two flanges 113, 114 along opposite sides. The free edges of these flanges 113, 114 act as feet upon which the plate 110 will stand in the channel-shaped back plate 100, thereby creating a space beneath said plate (when the plate is disposed as seen in FIG. 20) which is for the accommodation of the usual spirally wound spring (not illustrated) similar to the spring 13 shown in FIG. 1. The flange 113 and a part of the body of the plate 110 is cut away at 115 to provide an anchorage for one end of said spirally wound spring (see FIG. 21). It will be appreciated that the width dimension of the plate 110 is substantially equal to that of the channel in which it is to be placed, the purpose being to prevent substantially all movement of said plate 110 relative to the back plate 100.

Figure 19:
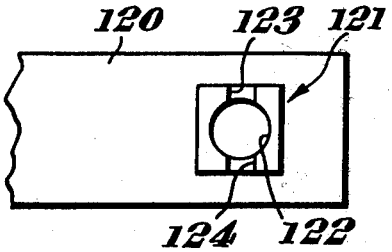
FIG. 19 illustrates part of a lever and the barrel thereof, said barrel being modified as compared with that shown on the lever in FIGS. 7 and 8.

The shaped other end of said spirally wound spring is intended to engage the barrel on the lever. The lever 120 is shown in FIG. 19 and is constituted, as already explained with reference to FIGS. 2 to 8, by a unit cut off an elongated extrusion. A barrel 121 has been appropriately formed and consists of a right-cylindrical recess 122 drilled in a protuberance which is square in plan, two diametrically opposed slots 123, 124 being cut in the wall of the recess. The slots 123, 124 extend from the free end of the protuberance to points which are short of the flat surface of the lever from which the protuberance projects. It will be appreciated that the approximately C-shaped portions which comprise the essential part of the barrel 121 are much stronger than are the parallel flanges 63, 64 of the previously described embodiment.

Of course, the slots 123, 124 do not need to be formed as a result of a separate operating step; the extrusion could be approximately shaped to enable said spaced slots to be produced when the recess 122 is drilled.

Figure 17:
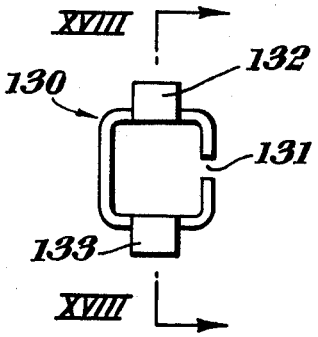
FIGS. 17 and 18 illustrate in plan and in section on the line XVIII — XVIII, respectively, another insert for use in said alternative embodiment.
Figure 18:
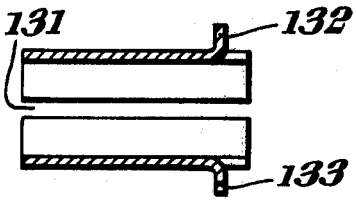

The insert shown in FIGS. 17 and 18, unlike the insert shown in FIGS. 9, 10 and 11, is a pressing. Said insert 130 therefore has a continuous slot 131 in one side thereof and this has the advantage that the edges which define said slot can be moved towards one another as a result of possible deformation of the square-section hollow insert occuring when placing said insert in the recess 122. Said insert has outwardly bent tongues 132, 133 for the same purpose as explained with reference to the previously described emodiment.

Figure 15:
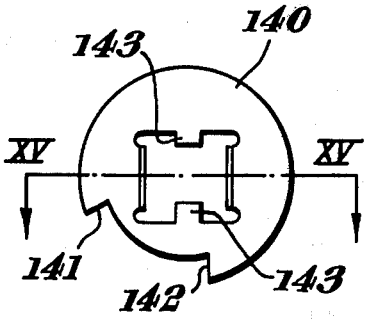
FIGS. 15 and 16 illustrate in plan and in section on the line XV — XV, respectively, another double D-plate for use in an alternative embodiment of the present invention.
Figure 16:
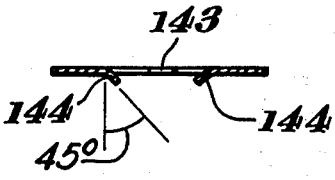

FIGS. 15 and 16 show a device or locking washer 140 which is essentially the same as that described with reference to FIGS. 13 and 14, said device having two angularly spaced abutments, 141, 142 and two opposed lugs 143. Opposed lugs 144 are upset to angles of 45°.

The assembly shown in FIG. 21 consists of a back plate 100 appropriately apertured to permit the extension therethrough of the barrel 121 of the lever 120, said barrel also extending through the aperture 111 and in the plate 110. One end 150 of the spirally wound spring is seen projecting through the cut-away 115, the other end of said spring encircling said barrel. The insert 130 is then placed in said recess 121 in the barrel with the tongues 132, 133 in the slots 123, 124 or vice versa. Thereafter, the device 140 is forced downwardly towards the plate 110 so that (a) the abutment 142 is adjacent one end of the upset stop 112 as illustrated, and (b) the lugs 143 lie over the top of the tongues 132, 133. The lugs 144 will slide downwardly over the surfaces of the barrel 121 fairly easily but any attempt on the part of the device 140 to move from the desired position thereof away from the plate 110 will result in the free edges of the lugs 144 digging into the material (usually aluminium) from which the barrel is made.

The assembly is finished off from a sales point of view by the insertion, into the open ends of the channel-shaped back plate 100, of plugs 160 (only one shown in FIG. 21 which may be moulded from a synthetic resin material. Said plugs 160 will preferably have holes 161 therein for fixing screws, said holes matching up with holes 162 drilled in the back plate 100.

Modifications are of course possible without departing from the scope of the appended Claims. In a first modification, the square-section insert could be omitted and the square-section passageway or recess portion (which is necessary in order to transmit torque to the customary square-section bar extending through the door thickness) could be provided by a washer or other blank (not illustrated) being connected to the barrel in any appropriate manner (for example by welding), said washer or blank having a square hole through it. The thickness and hardness of the material from which the washer or blank would need to be made would need to be such that said square hole would remain square for an acceptable length of time without exhibiting an undue degree of wear due to repeated use. In this first modification, the locking washer secures the lever to the back plate and also provides the spaced abutments which coact with the stop.

In a second modification which also dispenses with the squaresection insert, said locking washer may be provided with appropriately fashioned lugs (preferably diametrically opposed lugs), the free edges of said lugs being intended to grip the two flat faces of the customary squaresection bar which extends through the thickness of the door. Said lugs would obviously need to extend through appropriately formed slots in the barrel. In this second modification, the locking washer itself performs three distinct and vital functions, namely, torque transmission, locking together of the lever and the back plate and limitation of angular movement of the lever relative to the back plate.

What we claim is:

1. A latch or lock set which comprises, in combination:

a. a back plate and a lever or handle which has an integral barrel projecting laterally from one end thereof, the back plate being apertured to permit the extension therethrough of said barrel;

b. a spring means having one end portion snugly encircling and connected to said barrel and the other end portion engaging a fixed anchorage on said back plate;

c. a right cylindrical recess formed in said barrel from the free end thereof and an insert in said recess, the insert being hollow and of square section and having tongues projecting laterally therefrom into slots formed in the free end of the barrel;

d. a locking washer mounted on said barrel and having lugs which also project into said slots and overlie said tongues, said locking washer additionally having internal tab portions in resilient engagement with said barrel so as substantially to prevent any movement of said locking washer relative to said barrel after the lugs on the washer have been correctly positioned in relation to said tongues;

e. a stop element on the back plate in the plane of said washer; and f. said locking washer also incorporating angularly spaced opposed abutments which coact one at a time with said stop element to limit the extent of angular movement of said lever about the axis of rotation of said barrel either against or under the influence of said spring means.

2. A latch or lock set as claimed in claim 1, wherein said latch plate is made from a channel-shaped extrusion whose open ends are closed by plugs, both said stop and said fixed anchorage for the other end portion of the spring means being provided by an apertured plate which is placed in the channel of said back plate and which is of a shape and dimensions such that it is unable to rotate in said channel about the axis of the aperture in said apertured plate, said spring means being accommodated between facing surfaces of said back plate and said apertured plate and the barrel extending not only through the back plate but also through said apertured plate.

3. A latch or lock set for a door which comprises, in combination:- a. back plate and a lever which has an integral barrel with the back plate being apertured to permit the extension therethrough of said barrel;

b. a spring means having one end portion operatively connected to said barrel and the other end portion engaging fixed anchorage on said back plate;

c. means associated with said barrel and defining a passageway of square section adpated nonrotatably to receive a square bar;

d. a locking washer assembled on said barrel from the free end thereof having an aperture to receive said barrel and resilient tongue portions extending inwardly at the periphery of said aperture for sliding engagement with said barrel, said tongues deflecting as the washer is mounted on said barrel and preventing movement of said locking washer in disassembling direction on said barrel, whereby said back plate and lever are firmly connected to one another;

e. a stop element on said plate in the plane of said locking washer; and f. said locking washer incorporating angularly spaced abutments which coact one at a time with said stop element to limit the extent of angular movement of said lever about the axis of rotation of said barrel either against or under the influence of said spring means.

4. A latch or lock set for a door which comprises, in combination:- a. a back plate and a lever which has an integral barrel, the back plate being apertured to permit the extension therethrough of said barrel;

b. torsion spring means having one end portion connected to the barrel and the other end portion engaging a fixed anchorage on said back plate;

c. a recess extending axially into said barrel from the free end thereof;

d. said barrel having transverse slots formed in the free end thereof;

e. a sleeve rectangular in cross section mounted in said recess from the free end of said barrel and having lugs extending outwardly from the sleeve into said slots in the barrel end;

f. a locking washer mounted on said barrel from the free end of the barrel and having tabs which project into said slots formed in the barrel end and hold said sleeve captive in said recess, said lugs and slots constituting means for transmitting torque from said lever to a square-section bar extending through the door and having one end in said sleeve, said locking washer additionally having resilient edge portions which are deflected by engagement with said barrel when the washer is mounted on the barrel so as substantially to prevent any axial movement of said locking washer relative to said barrel and thereby firmly connecting said lever to said back plate;

g. a stop element on said plate in the plane of said locking washer; and h. said locking washer incorporating angularly spaced abutments which coact one at a time with said stop element to limit the extent of angular movement of said lever about the axis of rotation of said barrel either against or under the influence of said spring means.

5. A method of making a door lever which is operable when mounted in a door for nonrotatively engaging a noncircular shaft inside the door, said method comprising forming a lever portion and a barrel portion connected thereto, forming a cylindrical recess axially into said barrel portion form the end opposite said lever portion, placing an insert in said recess which is formed for drivingly nonrotating said shaft, and locking said insert in said recess against axial or rotative movement thereof.

6. A latch actuator device for a door comprising; a back plate having an aperture formed therein, a door lever which includes a first portion in the form of a barrel extending through said aperture and second portion in the form of a handle connected to one end of said barrel and disposed on one side of said plate, a right-cylindrical recess formed in said barrel from the free end thereof, an elongated hollow noncircular insert accommodated in said recess, said insert having radially outwardly extending lugs near the outer end and said barrel having a lateral slot in the free end receiving said lugs, and a lock washer pressed on the barrel from the free end and into spring engagement with said barrel, said washer having tabs extending inwardly into said slot in overlying relation to said lugs to keep said insert in a predetermined axial position within said recess, said lock washer also retaining said lever in assembled relation with said lock plate, at least one of said lugs on said insert and said tabs on said washer forming means for preventing rotation of said insert in said recess.

7. A door lever as claimed in claim 6, wherein said lock washer includes circumferentially spaced opposed abutments formed on the periphery thereof and said lock plate has a stop element thereon in the plane of said lock washer and disposed between said abutments.

* * * * *